US006796425B2

(12) United States Patent
Ahoff

(10) Patent No.: US 6,796,425 B2
(45) Date of Patent: Sep. 28, 2004

(54) GARMENT HOLDER

(76) Inventor: Marilyn Ahoff, 51 Trigwell Bay, Winnipeg, MB (CA), R3K 0H7

( * ) Notice: Subject to any disclaimer, the term of this patent is extended or adjusted under 35 U.S.C. 154(b) by 141 days.

(21) Appl. No.: 10/295,047

(22) Filed: Nov. 15, 2002

(65) Prior Publication Data

US 2004/0094438 A1 May 20, 2004

(51) Int. Cl.[7] ..... B65D 85/18
(52) U.S. Cl. ..... 206/293; 206/298
(58) Field of Search ..... 206/278, 279, 206/289, 292, 293, 295

(56) References Cited

U.S. PATENT DOCUMENTS 2,383,389 A * 8/1945 Illion ..... 206/278
2,502,033 A * 3/1950 Bohn ..... 206/293
2,723,734 A * 11/1955 Bellamy ..... 190/110
3,621,991 A * 11/1971 Richter ..... 206/289
5,255,766 A * 10/1993 Deconinck ..... 206/292
5,624,026 A * 4/1997 Chernoff ..... 206/289
5,887,711 A * 3/1999 McAuliffe ..... 206/292

* cited by examiner

*Primary Examiner*—Luan K. Bui

(57) ABSTRACT

A garment holder made up of a cylindrical body of a suitable length and diameter that a garment can be rolled around it without becoming unacceptably wrinkled, and garment retaining means to hold the garment securely in its rolled position, and securing means to keep the garment retaining means from disengaging their hold on the garment.

21 Claims, 3 Drawing Sheets

GARMENT HOLDER

DESCRIPTION

1. Technical Field

The present invention relates in general to devices designed to reduce the amount of wrinkling a garment will suffer, and more particularly to a device designed to keep a garment from becoming unacceptably wrinkled inside a suit case or other garment carrying means which does not provide enough room for the full length of the garment.

2. Background Art

Devices have been invented which allow garments to be carried, full length, in garment carrying bags that must be either hung up or laid flat. Such prior art garment holding inventions have the obvious disadvantage that they require a relatively large amount of space during carriage, or that they require a place where they can be hung up during carriage.

To the best of the Inventor's knowledge there does not exist a garment holder which reduces the amount of wrinkling a garment will suffer, and which allows garments to be carried, in a less than full length manner, in ordinary luggage items, such as suit cases, duffel bags, and even golf club bags.

To the best of the Inventor's knowledge there does not exist a garment holder which reduces the amount of wrinkling a garment will suffer, and which may be placed on shelves, in drawers, on car seats, in car trunks, and even in larger sized automobile glove compartments.

SUMMARY OF THE INVENTION

An object of the present invention was to design a garment holder that would reduce the wrinkling a garment suffers while it is in luggage, and which garment holder did not require the garment to be placed full length in the luggage.

A second object of the present invention was to design a garment holder that would reduce a garment's wrinkling and at the same time allow a garment to be rolled into a size smaller than its full length, and be stored or carried in that rolled state.

A third object of the present invention was to design a garment holder that met the first two objects, and which was small enough to fit into ordinary luggage, duffel bags, and golf club carrying bags.

A fourth object of the present invention was to design a garment holder that met the first three objects, and was relatively inexpensive to produce.

A fifth object of the present invention was to design a garment holder that met the first four objects, and was relatively easy to use.

The objects of the invention are accomplished by constructing a garment holder that is comprised of: a cylindrical body that has a first end and a second end; and a garment retaining means attached to at least one of the first end or second end of the cylindrical body, which garment retaining means is able to tightly hold any intended garment onto the cylindrical body; and a securing means, which is able to tightly hold the garment retaining means after a garment for which the garment holder was intended has been rolled onto said cylindrical body, and after the garment retaining means has been placed over the garment along the length of a first portion of the cylindrical body and along the length of a second portion of the cylindrical body, which second portion of the cylindrical body is diametrically opposed to the aforesaid first portion of the cylindrical body; and wherein the cylindrical body is of a suitable diameter such that any garment for which the garment holder was intended can be rolled onto the cylindrical body without becoming unacceptably wrinkled There are many advantages to the invention. It will reduce the wrinkling that a garment suffers while it is in luggage without requiring the garment to be placed full length in the luggage. The present invention will at the same time allow a garment to be rolled into a size smaller than its full length and be stored or carried in that rolled state. Further, the present invention results in a garment holder that can be made small enough to fit into ordinary luggage, duffel bags, and golf club carrying bags. In addition, the instant invention is relatively inexpensive to produce, and is relatively easy to use.

DETAILED DESCRIPTION OF THE PREFERRED EMBODIMENTS

Figure 1:
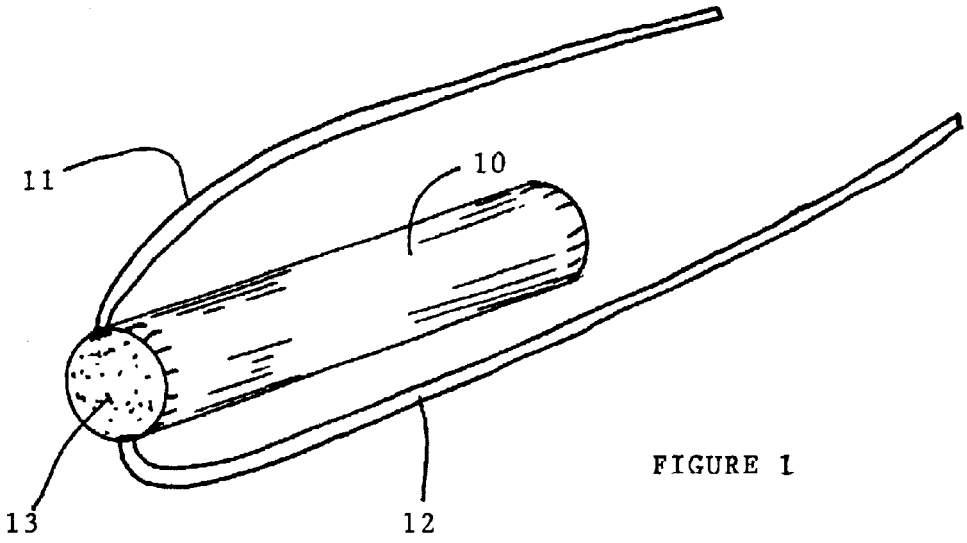
FIG. 1 is a perspective view of a garment holder of the present invention which has two garment retaining means at one of its ends.
Figure 2:
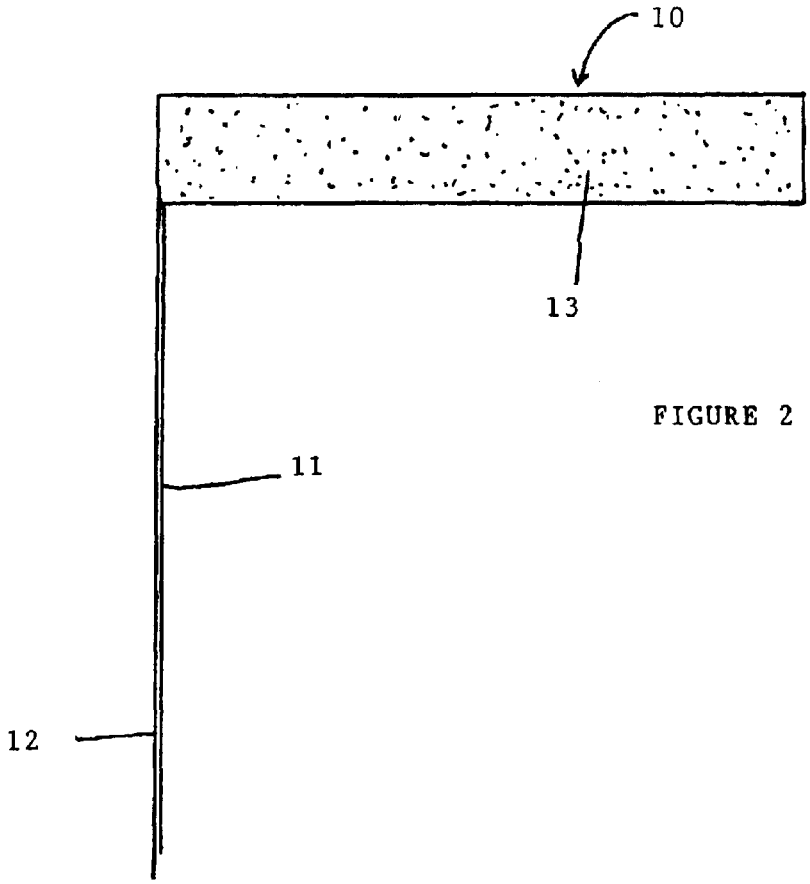
FIG. 2 is a horizontal section of the garment holder shown in FIG. 1.
Figure 3:
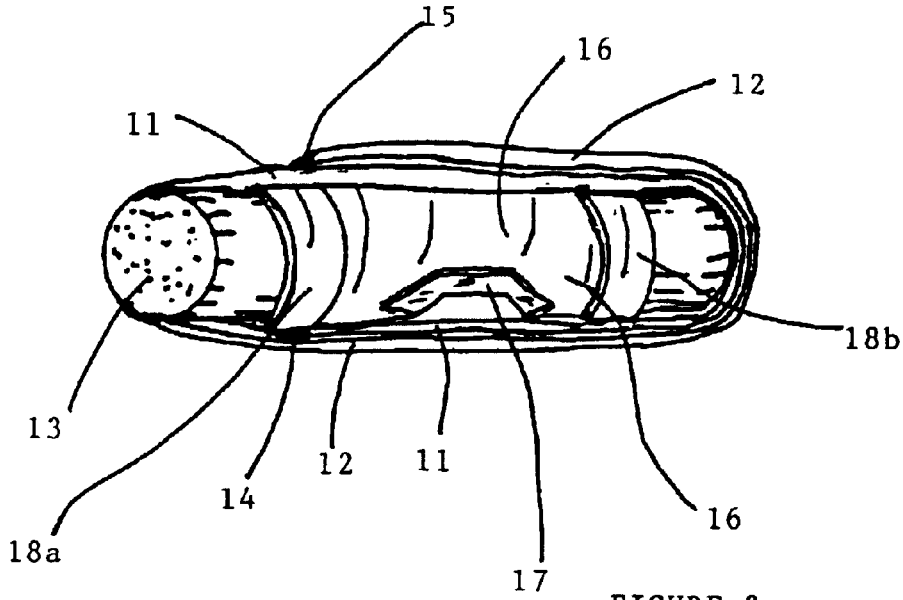
FIG. 3 is a perspective view of a garment holder of the present invention with a jacket rolled around it and being held in place by the garment retaining means.

A preferred embodiment of a garment holder of the present invention is illustrated in FIGS. 1 and 2. It is made up of a cylindrical body 10, a first garment retaining means 11, and a second garment retaining means 12, and a securing means which is not shown. The cylindrical body is made up of a dense cellular foam as show at 13. The garment retaining means 11 and 12 are straps. The securing means is a hook and loop closure device such as VELCRO; with one of the straps 11 or 12 being entirely covered with or made out of the hook portion, and the other strap being entirely covered with or made out of the loop portion. The operation of the invention illustrated in FIGS. 1 and 2 is shown in FIG. 3. Any suitable garment, such as a jacket, sweater, blouse, pants, etc., may be rolled onto the cylindrical body. In FIG. 3 a jacket has been rolled onto the cylindrical body. In FIG. 3, the jacket's collar 17, arms 18*a* and 18*b*, and its body 16, can all be seen in their rolled state. After the garment has been rolled onto the cylindrical body, strap 11 is pulled over the garment, from its point of attachment at one end of the cylindrical body, along the length of the cylindrical body, to the opposite end of the cylindrical body, it is then pulled diametrically across said opposite end of the cylindrical body and then pulled over the garment along the length of the cylindrical body until its non-attached end 14 is proximate the attached end of strap 12. Strap 12 is then placed, in connective contact, along and on top of strap 11, until its non-attached end 15 is proximate the attached end of strap 11. Because straps 11 and 12 form a VELCRO type hook and loop closure device, when they are placed in contact with each other they form a securing means by which they are held in place.

The straps 11 and 12 do not have to be entirely made up of or covered in their specific half of the hook and loop closure device, only enough of each of the straps 11 and 12 must be made up of or covered in their specific half of the hook and loop closure device such that when the invention is in use there is sufficient of their securing means, which is the hook and loop closure device, in contact, to provide a secure holding together of straps 11 and 12.

The embodiment shown in FIG. 1 could alternatively be made with straps 11 and 12 being shorter than shown in FIG. 1, for example, the straps could be of a length equal to the length plus radius of the cylindrical body, with the securing means being located on the end of the cylindrical body opposite to the end to which straps 11 and 12 are attached, or with one portion of the securing means being on the end of the strap 11 and a complimentary portion of the securing means being on the end of strap 12; or with one portion of the securing means being on the end of strap 11 and one portion of the securing means being on the end of strap 12, and a portion of the securing means complimentary to the portions that are on the ends of straps 11 and 12, being on the end of the cylindrical body that is opposite to the end to which straps 11 and 12 are attached. In such an embodiment after a garment has been rolled around the cylindrical body 10, strap 11 is pulled over and across the garment to the end of the cylindrical body opposite to the end at which it is attached to the cylindrical body, and strap 12 is pulled over and across the garment to the end of the cylindrical body opposite to the end at which it is attached to the cylindrical body, and the securing means is then engaged to tightly hold straps 11 and 12.

Figure 6:
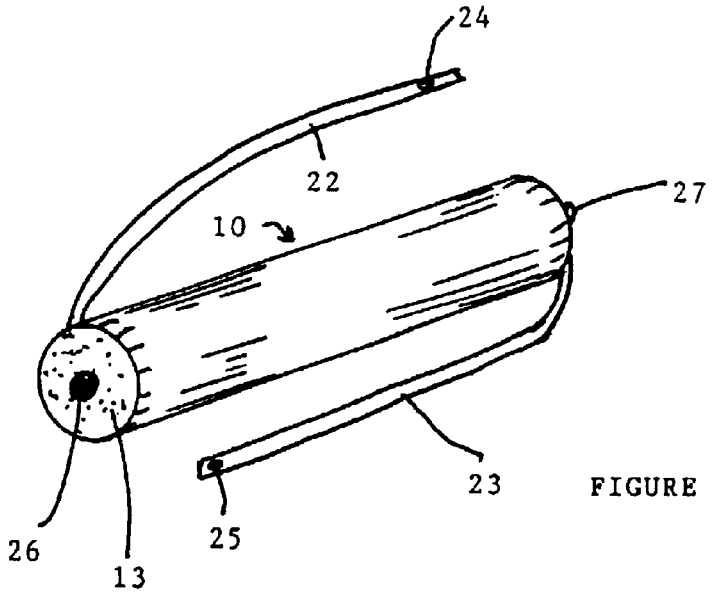
FIG. 6 is a perspective view of a garment holder of the present invention which has a single garment retaining means at each of its ends.

FIG. 6 illustrates an embodiment of the invention made up of a cylindrical body 10, made out of a dense cellular foam material as shown at 13, and which is further made up of straps 22 and 23 that are each made out of an elastic material, and which is further made up of a securing means that is the buttons 26 and 27 to which the straps can be attached by means of their respective button holes 24 and 25. Strap 22 has a button hole 24 proximate its free end, and strap 23 has a button hole 25 proximate its free end. In operation, after a garment has been rolled around the cylindrical body 10, strap 22 is pulled over and across the garment and fastened onto button 27, similarly strap 23 is pulled over and across the garment and fastened onto button 26. Each of straps 24 and 23 are shorter than the length of cylindrical body 10; their optimum length will depend on the elasticity of the material chosen and on the type of garment which the garment holder is intended to hold, and will be obvious to people skilled in the field to which the invention pertains.

Figure 7:
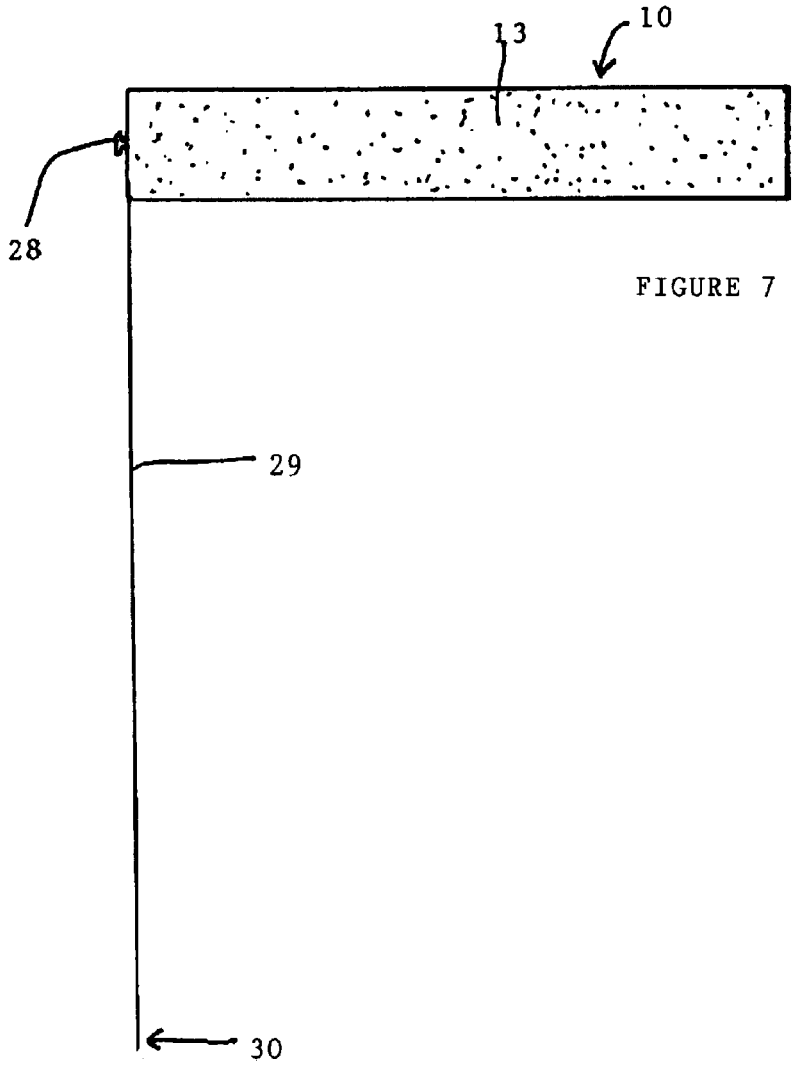
FIG. 7 is a horizontal section of a garment holder of the present invention which has a single garment retaining means at one of its ends.

FIG. 7 illustrates an embodiment of the invention made up of a cylindrical body 10, made out of a dense cellular foam material as shown at 13, and which is further made up of a strap 29, made out of an elastic material, and which is approximately twice the length of the cylindrical body 10, and is further made up of a securing means that is the button 28 to which the strap 29 can be attached by means of button 28. In operation, after a garment has been rolled around the cylindrical body 10, strap 29 is pulled over and across the garment toward the end of cylindrical body 10 opposite the end on which button 28 has been attached, and then diametrically across the end opposite the end on which button 28 has been attached, and then over and across the garment towards the button 28, and then button hole 30 is fastened onto button 28. The optimum length of strap 29 will depend on the elasticity of the material chosen and on the type of garment which the garment holder is intended to hold, and will be obvious to people skilled in the field to which the invention pertains.

The strap or straps of the invention do not have to be made out of an elastic material, as long as they can be pulled tightly around the rolled garment and then held in place by the securing means.

The diameter of the cylindrical body and the length of the cylindrical body of the invention will be different depending on the type and size of garment for which the garment holder is being constructed. If a garment holder is being constructed for a large over coat it will be of a longer length and of a larger diameter than if it is being constructed for a blouse. The length and diameter of cylindrical body to use for specific types of garments will be obvious to those in the field to which the invention pertains. For an average sized woman's jacket a cylindrical body of 15" long and 2½" in diameter is recommended.

Figure 4:
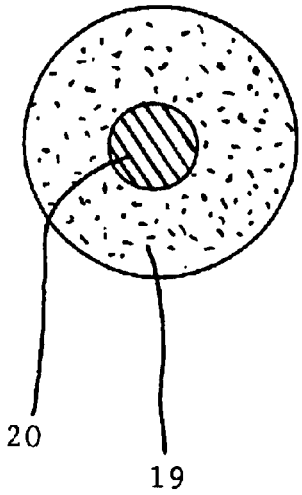
FIG. 4 is a cross section through a cellular foam cylindrical body with a solid core, of the type that can be used in the present invention.
Figure 5:
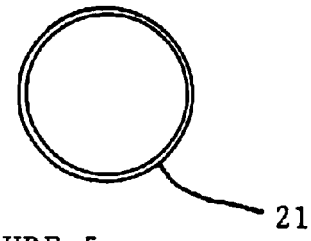
FIG. 5 is a cross section through a solid cylindrical body of the type that can be used in the present invention.

For the invention the cylindrical body does not have to be made out of a dense cellular foam, though that is the preferred material for the present invention. FIG. 4 illustrates a cylindrical body that is made out of a cellular foam 19 and also contains a solid core 20. The solid core 20 can be made of any solid material, such as wood, plastic, cardboard, etc. The relative diameters of the solid core 20 and the cellular foam 19 also need not be as shown in FIG. 4. The cylindrical body can also be made out of solid material 21, such as plastic, as shown in FIG. 5, or out of solid material such as cardboard, etc. For all of the embodiments of the invention the securing means can be a buckling mechanism, a friction mechanism, a button and button hole, a hook and loop device like VELCRO, or any other means that will hold the strap or straps in place after they have been pulled over and around the garment as intended.

The rolling of the garment around the cylindrical body is an activity which does not produce significant wrinkling. Further, a garment that has been correctly rolled around a cylinder can remain rolled for a long period of time and it will not gain significant wrinkling from remaining in the rolled state. Then, because the garment is contacted and held firmly in place by the garment retaining means along the garment's entire length along a first length of the cylindrical body and the garment is again contacted and held firmly in place by the garment retaining means along its entire length along a second length of the cylindrical body that is diametrically opposite to the first length of the cylindrical body, the garment remains in a state that resists wrinkling. When the preferred construction of the cylindrical body is used, which is that it is made out of a relatively dense cellular foam, the garment holder will also act to resist the garment from becoming wrinkled even when it is placed in luggage or a container that is compressing the garment and garment retaining means. The preceding are clear advantages to the invention. Another clear advantage to any construction of the invention is that it allows a garment to be rolled, without any significant wrinkling of the garment, and then stored or carried in a much smaller two dimensional foot print than the garment's full length would require. Hence the garment can be placed in a normal suitcase or even in the large pocket of a golf club bag, and be carried without significant wrinkling occurring to the garment. Another advantage to the invention is that it can be made quite inexpensively, the cost of cellular foam, plastic, or cardboard is not high and neither is the cost of straps, buttons, or material like VELCRO. The construction is also fairly simple, normally requiring little more than the sewing on of the straps and of the securing means, which in some embodiments can be the straps themselves, if they are made out of a material like VELCRO. In other cases the securing means are as simple as buttons, and their attachment to the invention only requires that they be sewn on. The invention is also easy to use, which is a further advantage. The invention, especially in the embodiments illustrated in FIGS. 1, 2, 3, 6 and 7 also allows a quick engagement of the garment and a quick disengagement of the garment, which is also an advantage.

Variations to the invention can be made, as shown by way of example in the various embodiments illustrated in the figures and as explained in the disclosure; in addition, other variations will be obvious to those skilled in the art, and they are covered by the appended claims, as they are within the scope of the invention.

I claim:

1. A garment holder that is comprised of:

a.) a cylindrical body having a first end and a second end, which cylindrical body is of a suitable diameter, that any garment for which the garment holder was intended, can be rolled onto said cylindrical body, without becoming unacceptably wrinkled;

b.) a garment retaining means attached to at least one of the first end or second end of the cylindrical body, which garment retaining means is capable of tightly holding any garment, for which the garment holder was intended, onto the cylindrical body; and c.) a securing means, which is able to tightly hold the garment retaining means, after a garment for which the garment holder was intended, has been rolled onto said cylindrical body, and after the garment retaining means has been placed over the garment along the length of a first portion of the cylindrical body, called portion CBA, and along the length of a second portion of the cylindrical body, which second portion of the cylindrical body is diametrically opposed to portion CBA.

2. A garment holder as described in claim 1 in which the cylindrical body is made out of a suitably dense cellular foam material.

3. A garment holder as described in claim 1 in which the cylindrical body is made out of plastic.

4. A garment holder as described in claim 1 in which the cylindrical body is made out of cardboard.

5. A garment holder as described in claim 1 in which the cylindrical body is made out of a suitably dense cellular foam material; and which is further comprised of a hard inner cylindrical body of the same length as the cylindrical body but of a lesser diameter; and wherein the inner cylindrical body is situated concentrically within the cylindrical body.

6. A garment holder as described in claim 1 in which the securing means is a hook and loop closure device such as VELCRO.

7. A garment holder as described in claim 1 in which the garment retaining means is a strap and in which the securing means holds the strap in the closed position.

8. A garment holder that is comprised of:

a.) a cylindrical body having a first end and a second end, which cylindrical body is of a suitable diameter, that any garment for which the garment holder was intended, can be rolled onto said cylindrical body, without becoming unacceptably wrinkled;

b.) a first garment retaining means attached to the first end of the cylindrical body;

c.) a second garment retaining means attached to the first end of the cylindrical body at a point that is diametrically opposite to the point of the first end of the cylindrical body at which the first garment retaining means is attached; and d.) a securing means that is able to tightly hold the first garment retaining means and the second garment retaining means after a garment for which the garment holder was intended has been rolled onto said cylindrical body, and after the garment is contacted by at least one of the garment retaining means along the length of a first portion of the cylindrical body, called portion CBA, and along the length of a second portion of the cylindrical body, which second portion of the cylindrical body is diametrically opposed to portion CBA.

9. A garment holder as described in claim 8 in which the cylindrical body is made out of a suitably dense cellular foam material.

10. A garment holder as described in claim 8 in which the cylindrical body is made out of plastic.

11. A garment holder as described in claim 8 in which the cylindrical body is made out of cardboard.

12. A garment holder as described in claim 8 in which the cylindrical body is made out of a suitably dense cellular foam material; and which is further comprised of a hard inner cylindrical body of the same length as the cylindrical body but of a lesser diameter; and wherein the inner cylindrical body is situated concentrically within the cylindrical body.

13. A garment holder as described in claim 8 in which the first garment retaining means is a strap and in which the securing means is a hook and loop closure device such as VELCRO, one part of which is on the first garment retaining means, and in which the second garment retaining means is a strap on which is situated the other part of the securing means.

14. A garment holder as described in claim 8 in which the first garment retaining means and the second garment retaining means are both straps; and in which the securing means is comprised of a first securing means and a second securing means, and in which the first securing means holds the first garment retaining means in the closed position, and in which the second securing means holds the second garment retaining means in the closed position.

15. A garment holder that is comprised of:

a.) a cylindrical body having a first end and a second end, which cylindrical body is of a suitable diameter, that any garment for which the garment holder was intended, can be rolled onto said cylindrical body, without becoming unacceptably wrinkled;

b.) a first garment retaining means attached to the first end of the cylindrical body;

c.) a second garment retaining means attached to the second end of the cylindrical body; and d.) a securing means that is able to tightly hold the first garment retaining means and the second garment retaining means after a garment for which the garment holder was intended has been rolled onto said cylindrical body, and after the garment is contacted by at least one of the garment retaining means along the length of a first portion of the cylindrical body, called portion CBA, and along the length of a second portion of the cylindrical body, which second portion of the cylindrical body is diametrically opposed to portion CBA.

16. A garment holder as described in claim 15 in which the cylindrical body is made out of a suitably dense cellular foam material.

17. A garment holder as described in claim 15 in which the cylindrical body is made out of plastic.

18. A garment holder as described in claim 15 in which the cylindrical body is made out of cardboard.

19. A garment holder as described in claim 15 in which the cylindrical body is made out of a suitably dense cellular foam material; and which is further comprised of a hard inner cylindrical body of the same length as the cylindrical body but of a lesser diameter; and wherein the inner cylindrical body is situated concentrically within the cylindrical body.

20. A garment holder as described in claim 15 in which the first garment retaining means is a strap and in which the securing means is a hook and loop closure device such as VELCRO, one part of which is on the first garment retaining means, and in which the second garment retaining means is a strap on which is situated the other part of the securing means.

21. A garment holder as described in claim 15 in which the first garment retaining means and the second garment retaining means are both straps; and in which the securing means is comprised of a first securing means and a second securing means, and in which the first securing means holds the first garment retaining means in the closed position, and in which the second securing means holds the second garment retaining means in the closed position.

* * * * *